US008025361B2

(12) United States Patent
Ide

(10) Patent No.: US 8,025,361 B2
(45) Date of Patent: Sep. 27, 2011

(54) LIQUID JET HEAD AND LIQUID JET APPARATUS

(75) Inventor: Katsuya Ide, Suwa (JP)

(73) Assignee: Seiko Epson Corporation (JP)

( * ) Notice: Subject to any disclaimer, the term of this patent is extended or adjusted under 35 U.S.C. 154(b) by 416 days.

(21) Appl. No.: 12/270,097

(22) Filed: Nov. 13, 2008

(65) Prior Publication Data

US 2009/0128605 A1 May 21, 2009

(30) Foreign Application Priority Data

Nov. 20, 2007 (JP) ..... 2007-300192

(51) Int. Cl.
*B41J 2/14* (2006.01)

(52) U.S. Cl. ..... 347/47

(58) Field of Classification Search ..... 347/20, 347/47, 68

See application file for complete search history.

(56) References Cited

U.S. PATENT DOCUMENTS 7,182,432 B2 2/2007 Van Den Berg et al.
7,806,511 B2 * 10/2010 Ishikawa ..... 347/40

FOREIGN PATENT DOCUMENTS

JP 63-297048 12/1988
JP 05-338157 12/1993
JP 06-234218 8/1994
JP 2000-218792 8/2000
JP 2004-338381 12/2004

* cited by examiner

*Primary Examiner* — An H Do

(74) *Attorney, Agent, or Firm* — Harness, Dickey & Pierce, P.L.C.

(57) ABSTRACT

A liquid jet head that pressurizes liquid and ejects the liquid through nozzles includes: a nozzle opening surface having two nozzle rows each having openings of the nozzles linearly aligned in plurality; a pair of wall surfaces intersecting the nozzle opening surface at end sections of the nozzle opening surface, the wall surfaces being aligned with the nozzle rows, respectively; and pressure chambers that are in communication with the nozzles for reserving the liquid to be pressurized, formed in each of the pair of wall surfaces, wherein the liquid pressurized in the pressure chambers flows in a direction along each of the pair of wall surfaces, respectively.

6 Claims, 10 Drawing Sheets

LIQUID JET HEAD AND LIQUID JET APPARATUS

This application claims a priority to Japanese Patent Application No. 2007-3000192 filed on Nov. 20, 2007 which is hereby expressly incorporated by reference herein in its entirety.

BACKGROUND

1. Technical Field

The present invention relates to liquid jet heads for ejecting liquid and liquid jet apparatuses equipped with the liquid jet heads.

2. Related Art

Liquid jet apparatuses that eject liquid, such as, for example, functional liquid, ink and the like onto an object, such as, a sheet of paper, a glass substrate, and the like, for forming specified patterns and images thereon have been known. In such apparatuses, pressure chambers are provided in liquid flow paths where liquid, for example, ink flows, and liquid jet heads are used wherein pressures are applied to ink in the pressure chambers by using the electrostriction of piezoelectric elements, whereby the ink is ejected as ink droplets through nozzles located at the very ends of the flow paths.

Because there are needs for thinner liquid jet heads, for example, a structure described in Japanese Laid-open Patent Application JP-A-6-234218 is often used. In this structure, the pressure chamber is disposed in parallel with a plane in which the nozzles are formed. In other words, the pressure chamber is formed with its lengthwise direction being generally orthogonal to the ink ejection direction, whereby a deformation displacement of the vibration plate that composes the pressurizing unit can be made larger, and the thickness of the liquid jet head in a direction perpendicular to the nozzle opening surface where the nozzles are formed can be made thinner.

The liquid jet head described above is provided with a reservoir that is in communication with the pressure chamber and serves as a supply flow path for supplying ink to the pressure chamber. The reservoir is provided for stably replenishing ink in the pressure chamber upon ink ejection.

Accompanied by the trend toward higher image quality of images photographed by digital cameras in recent years, higher resolution prints are demanded. As a solution to such demands, it is well known that minimization of ink droplets may be effective, and it is also effective to increase the level of integration of nozzles to be formed on a liquid jet head. One of the methods to increase the level of integration is to shorten the distance between rows of nozzles.

When a plurality of rows of nozzles are formed on a liquid jet head by using the structure of a liquid jet head described in the aforementioned document, in particular, when there are two rows of nozzles, the distance between the rows of nozzles may be narrowed by placing the pressure chamber outside with respect to the rows of nozzles, for example, as indicated in FIG. 3 of the aforementioned document. However, an ordinary liquid jet apparatus may be used to eject plural kinds of liquids, such as, liquids in multiple colors (for example, yellow, magenta, cyan, black, etc.). Therefore, in order to eject plural kinds of liquids, a liquid jet head having multiple rows of nozzles, for example, four rows of nozzles, eight rows of nozzles, etc., is required. In this case, a pressure chamber is formed between the nozzle rows, such that the distance between adjacent ones of the nozzle rows needs to be made longer than at least the length of the pressure chamber in its lengthwise direction. As a result, the dimension of the pressure chamber in its lengthwise direction would impose a limitation to higher integration of nozzles.

Also, the reservoir is formed at a position that does not overlap the nozzles in a plane as viewed from the nozzle opening surface side, such that, when many nozzle rows, such as, four rows, eight rows or the like, are formed, the distance between adjacent ones of the nozzle rows would become greater according to the forming region of the reservoir.

SUMMARY

In accordance with an advantage of some aspects of the invention, at least portion of the problem described above can be solved, and the invention can be realized by the following embodiments or application examples.

In accordance with a first embodiment of the invention, a liquid jet head that pressurizes liquid and ejects the liquid through nozzles, the liquid jet head having: a nozzle opening surface having two nozzle rows each having openings of the nozzles linearly aligned in plurality; a pair of wall surfaces intersecting the nozzle opening surface at end sections of the nozzle opening surface, the wall surfaces being aligned with the nozzle rows, respectively; and pressure chambers that are in communication with the nozzles for reserving the liquid to be pressurized, formed in each of the pair of wall surfaces, wherein the liquid pressurized in the pressure chambers flows in a direction along each of the pair of wall surfaces, respectively.

According to the structure described above, the pressure chambers are formed in the wall surfaces that intersect the nozzle opening surface and are formed at end sections of the nozzle opening surface, and the liquid in the pressure chambers flows in a direction in parallel with the wall surfaces. Accordingly, the lengthwise direction of the pressure chambers can be set along a direction in parallel with the wall surfaces, such that the forming region of the pressure chambers in a direction orthogonal to the direction of the nozzle rows, as viewed toward the nozzle opening surface, can be restrained to a smaller area. As a result, the size of the liquid jet head in a direction orthogonal to the direction of the nozzle rows can be reduced, such that, when a plurality of liquid jet heads are arranged in parallel with one another, the gap between adjacent ones of the nozzle rows between the liquid jet heads can be narrowed. Accordingly, the level of integration of the nozzles can be increased.

In the liquid jet head in accordance with a second aspect of the embodiment of the invention, the pressure chambers formed in the pair of wall surface may be formed in a single member.

According to this structure, two rows of pressure chambers can be formed from a single member, such that gaps among the pressure chambers can be narrowed. As a result, when two nozzle rows are formed in a single liquid jet head, the gap between the nozzle rows can also be narrowed. Also, the single liquid jet head can be reduced in size in the direction orthogonal to the direction of the nozzle rows, such that, when plurality of liquid jet heads are arranged in parallel, the gap between adjacent ones of the nozzle rows among the liquid jet heads can be narrowed. Accordingly, the degree of integration of the nozzles can be increased.

The liquid jet head in accordance with a third aspect of the embodiment of the invention may be equipped with a supply flow path that is in communication with all of the pressure chambers formed along the two nozzle rows and supplies the liquid to the pressure chambers, wherein the supply flow path is formed on the opposite side of the nozzle opening surface through the pressure chambers.

According to this structure, the liquid supply flow path is formed on the opposite side of the nozzles through the pressure chambers, such that the nozzles and the supply flow path can be disposed in a manner to superpose one another as viewed from the side of the nozzle opening surface. Also, it only needs to form a single supply flow path for two nozzle rows, the plane area can be made smaller compared to the case of forming a supply flow path for each of the nozzle rows. As a result, an inkjet head with a small plane size can be obtained, and the overall plane area of the liquid jet head can be made smaller, such that the gap between adjacent ones of the nozzle rows between the liquid jet heads arranged next to each other can be narrowed.

In the liquid jet head in accordance with a fourth aspect of the embodiment of the invention, the pressure chambers formed along each of the two nozzle rows may all have an identical configuration, wherein the configurations are formed mutually shifted as viewed in a direction perpendicular to the wall surfaces.

According to this structure, the pressure chambers are arranged in a manner not to overlap one another, such that the distance between the wall surfaces can be narrowed. As a result, the distance between the two nozzle rows can be shortened, and thus the degree of integration of nozzles can be increased.

In the liquid jet head in accordance with a fifth aspect of the embodiment of the invention, each of the wall surfaces may have a pressurizing device for pressurizing liquid in the pressure chambers, and a frame having a height greater than a maximum thickness of at least the pressurizing device, provided at least near the end section of the nozzle opening surface in a range that does not hinder pressurizing driving of the pressurizing device.

According to the structure described above, when liquid jet heads each having two nozzle rows are arranged next to each other to form a liquid jet head apparatus having two or more nozzle rows, the distance between adjacent ones of the liquid jet heads can be adjusted by the frame having a height greater than the thickness of the pressurizing device to a minimum distance at which the pressurizing devices formed on the respective liquid jet heads do not interfere with each other, and the gap between the nozzle rows between the liquid jet heads can be narrowed. Also, by providing the frame, the rigidity of the liquid jet head can be increased.

A liquid jet apparatus in accordance with a sixth embodiment of the invention has at least two liquid jet heads described above.

By using the liquid jet heads, a liquid jet apparatus with a high level of integration of nozzles can be provided, such that the liquid jet apparatus that can print high resolution images can be provided.

DESCRIPTION OF EXEMPLARY EMBODIMENTS

Figure 1:
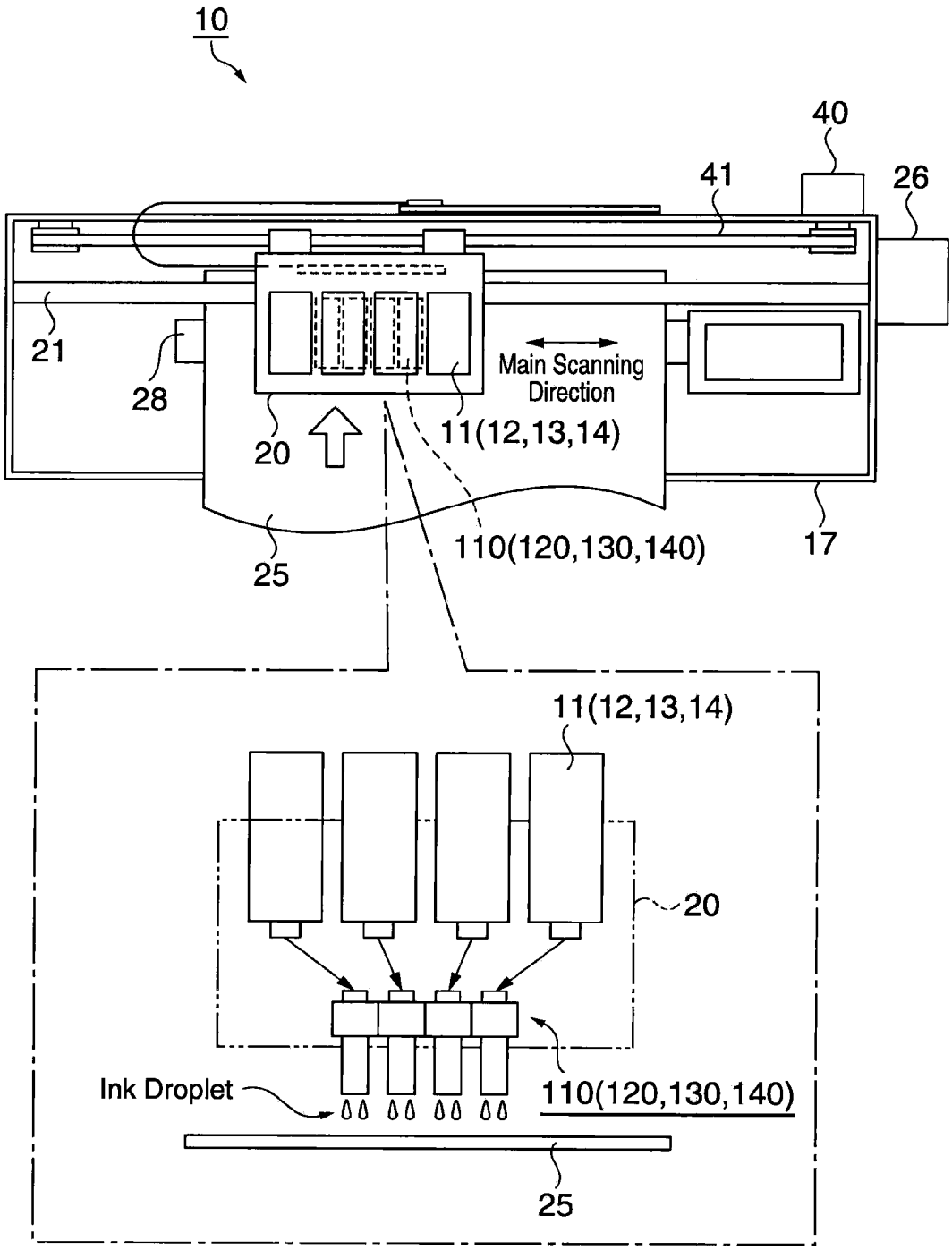
FIG. 1 is a schematic illustration of the structure of an ink jet printer in accordance with an embodiment of the invention.

A concrete example of an embodiment of the invention is described below. FIG. 1 is a schematic view of the structure of an ink jet printer 10, which is an example of a liquid jet apparatus, equipped with liquid jet heads in accordance with an embodiment of the invention. Also, a balloon in the figure shows a schematic view in which a carriage 20 to be described below is viewed in a direction of a white arrow. It is noted that, for the convenience of description, in the present embodiment, a direction viewed in the direction of the white arrow with the carriage 20 as a reference is defined as a front direction, and transverse directions are defined as left side and right side directions, respectively. Also, in the following description, a direction toward printing paper 25 is defined as downside, and its opposite direction as upside.

The ink jet printer 10 includes a carriage 20 on which ink cartridges 11, 12, 13 and 14 that store liquid, such as, for example, color inks of yellow (Y), magenta (M), cyan (C) and black (K) are mounted. Four liquid jet heads 110, 120, 130 and 140 corresponding to the respective color inks are arranged below the carriage 20, and ink droplets are ejected from the liquid jet heads 110-140 thereby printing predetermined images and the like on the printing paper 25.

The carriage 20 is affixed to a carriage belt 41, and is moved in a left-to-right direction in the figure (main scanning direction) along a guide 21 affixed to a frame 17 as the carriage belt 41 is driven by a carriage motor 40. Each of the liquid jet heads 110-140 is provided with a nozzle row composed of a plurality of nozzles linearly perforated in a direction orthogonal to the main scanning direction for ejection of each of the color inks. While the carriage 20 is moving, each of the color inks is ejected from the nozzle row as ink droplets in a predetermined amount according to a printing image. The printing paper 25 is supported at its back surface by a platen 28 and moved in a predetermined amount one by one in an up-and-down direction in the figure by paper feeding rollers (not shown) driven by a driving motor 26 affixed to the frame 17. In this manner, ink droplets in a predetermined amount according to a printing image are ejected onto the entire printing paper 25, whereby the image is formed.

Accordingly, as described above, by narrowing the gap between the nozzle rows in the scanning direction of the liquid jet head, the degree of integration of the nozzles is increased, and the image can be printed and formed with a higher resolution. In the ink jet printer 10, as shown in the balloon in FIG. 1, four liquid jet heads are arranged at narrow intervals. Also, each of the liquid jet heads has two nozzle rows, and the nozzle rows are also separated at a short distance. Within the carriage 20, flow paths (not shown) are formed for flowing ink supplied from each of the ink cartridges 11-14 to an ink inlet port provided at each of the four liquid jet heads 110-140, as shown by arrows in the figure.

In accordance with the present embodiment, the structure of the liquid jet head is devised to narrow the gaps between the nozzle rows to increase the degree of integration of nozzles. As a result, the distance in which the carriage 20 moves, for example, between ejection of ink from one of the nozzle rows and ejection of ink from the next one of the nozzle rows onto the same position on the printing paper 25, becomes shorter, and therefore the moving speed of the carriage 20 can be more controlled, whereby the accuracy of placement position of ink droplets can be increased. Accordingly, correct printing of images with a high resolution can be expected. Next, the liquid jet heads 110, 120, 130 and 140 are described in detail with reference to FIGS. 2-4. It is noted that the liquid jet heads 110-140 may have the same structure, and therefore only the liquid jet head 110 is described below.

Figure 2A:
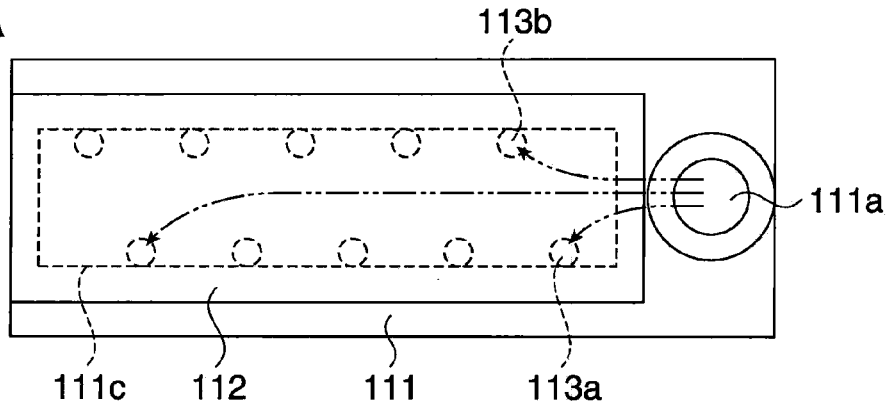
FIGS. 2A-2C are schematic views of the structure of a liquid jet head in accordance with an embodiment of the invention, wherein FIG. 2A schematically shows a state of the liquid jet head viewed from above, FIG. 2B schematically shows a state thereof viewed in its right side direction, and FIG. 2C schematically shows a state thereof viewed from below.
Figure 2B:
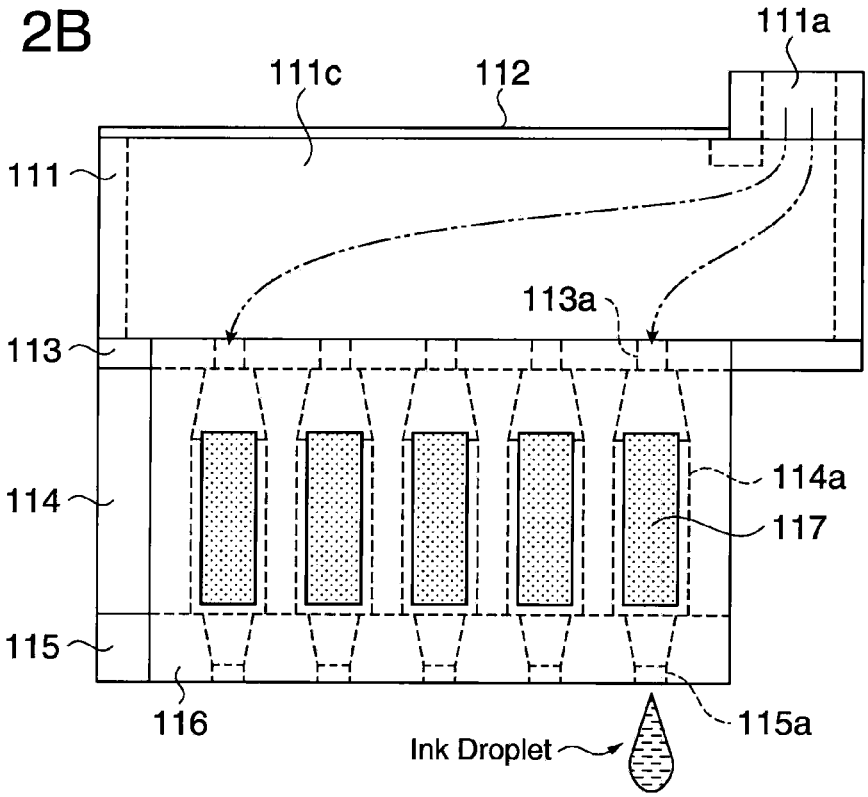
Figure 2C:
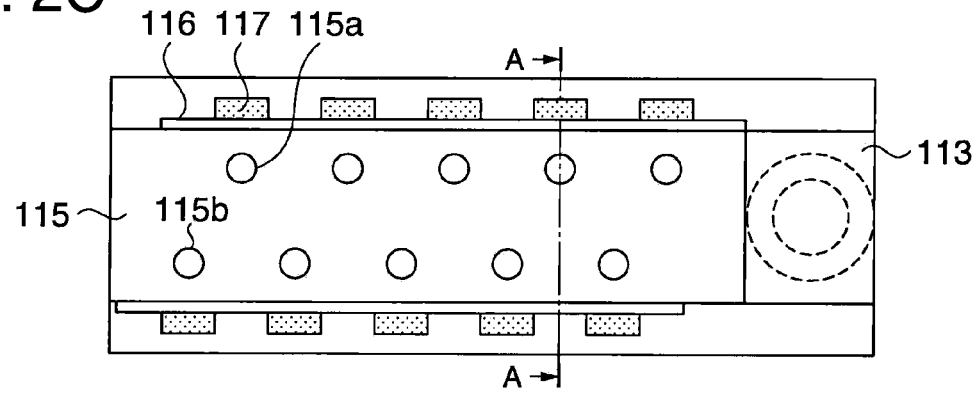

FIGS. 2A-2C are schematic views of the structure of the liquid jet head 110. FIG. 2A schematically shows a state of the liquid jet head 110 viewed from above, FIG. 2B schematically shows a state thereof viewed in the right side direction, and FIG. 2C schematically shows a state thereof viewed from below. The structure of the liquid jet head 110 in accordance with the present embodiment is described along the ink flow path.

First, as shown in FIG. 2A, ink supplied from the ink cartridge (11) flows in a supply flow path forming member 111 having an ink inlet port 111*a* that is an opening section. The ink flowed in the supply flow path forming member 111 flows through a supply flow path formed therein (hereafter referred to as a "reservoir") 111*c* to communication holes 113*a* and communication holes 113*b*, as indicated by two-dot and dash lines in the figure.

The reservoir 111*c* is formed from the supply flow path forming member 111, a thin film member 112 and a communication plate 113, which surround the reservoir 111*c*, as shown in FIG. 2B, wherein the communication holes 113*a* and 113*b* penetrate the communication plate. The ink flowed in the communication holes 113*a* flows in pressure chambers 114*a* formed in a pressure chamber forming member 114. Then, the ink flowed in the pressure chambers 114*a* is pressurized by a vibration plate 116 that is displaced by deformation driving of piezoelectric elements 117, and ejected as ink droplets through nozzles 116*a* formed in a nozzle plate 115. Although omitted in FIG. 2B, the ink flowed in the communication holes 113*b* is also similarly pressurized in pressure chambers 114*b* (see FIG. 3) formed in the pressure chamber forming member 114 on the left side, which is on the back side of the figure, and also ejected as ink droplets through nozzles 115*b* formed in the nozzle plate 115, as shown in FIG. 2C.

The supply flow path forming member 111, the communication plate 113, the pressure chamber forming member 114 and the nozzle plate 115 may be formed from metal plates (e.g., stainless steel plates in the present embodiment), respectively, and laminated and affixed mutually by adhesive, welding or the like. The thin film member 112 is formed from a thin plate of resin (e.g., polyphenylene sulfide resin (PPS) in the present embodiment) having flexibility for balancing vibrations of the ink generated in the reservoir 111*c* by ink droplet jetting operations and the like, and is affixed to an upper surface of the supply flow path forming member 111 by adhesive or welding.

Also, the vibration plate 116 may be formed from a ceramic plate (e.g., a zirconia plate in the present embodiment), and is affixed by adhesion on each of left and right side surfaces of the communication plate 113, the pressure chamber forming member 114 and the nozzle plate 115, as shown in FIG. 2B. Further, as shown in FIG. 2B, the piezoelectric elements 117 for pressurizing the ink in the pressure chambers 114*a* (114*b*) are attached to the surface of the vibration plate 116. Each of the piezoelectric elements 117 is formed from a thin plate of a piezoelectric material having electrostriction property, such as, lead zirconate titanate (PZT) or the like, which is narrower than the width (in the right-to-left direction in the figure) of the corresponding pressure chamber 114*a* (114*b*) and in an elongated shape in a lengthwise direction (in the up-and-down direction in the figure) of the pressure chamber 114*a* (114*b*), and is formed in a manner to curve in the width direction upon application of a voltage. An electrode (not shown) is connected and formed at the piezoelectric element 117, and the piezoelectric element 117 is formed in a manner to warp upon application of a predetermined driving signal to the electrode through an unshown wiring member, whereby the vibration plate 116 is deformed and the ink in the pressure chamber 114*a* (114*b*) is pressurized.

The liquid jet head 110 in accordance with the present embodiment is thus structured, thereby forming the ink flow paths. As a result, as indicated in FIG. 2C, two nozzle rows of the nozzles 115*a* and 115*b* that are generally linearly arranged at predetermined pitch intervals are formed, at locations corresponding to the pressure chambers 114*a* and 114*b* formed in the left and right side surfaces of the pressure chamber forming member 114, respectively. It is noted that the liquid jet head 110 in accordance with the present embodiment is described as having five nozzles to form each of the nozzle rows for simplification of the description, but may actually have several tens to several hundreds nozzles formed in each row.

Next, the pressure chambers 114*a* and 114*b* are described in greater detail with reference to FIG. 3. It is noted that FIG. 3 is a schematic cross-sectional view taken along a line A-A in FIG. 2C.

Figure 3:
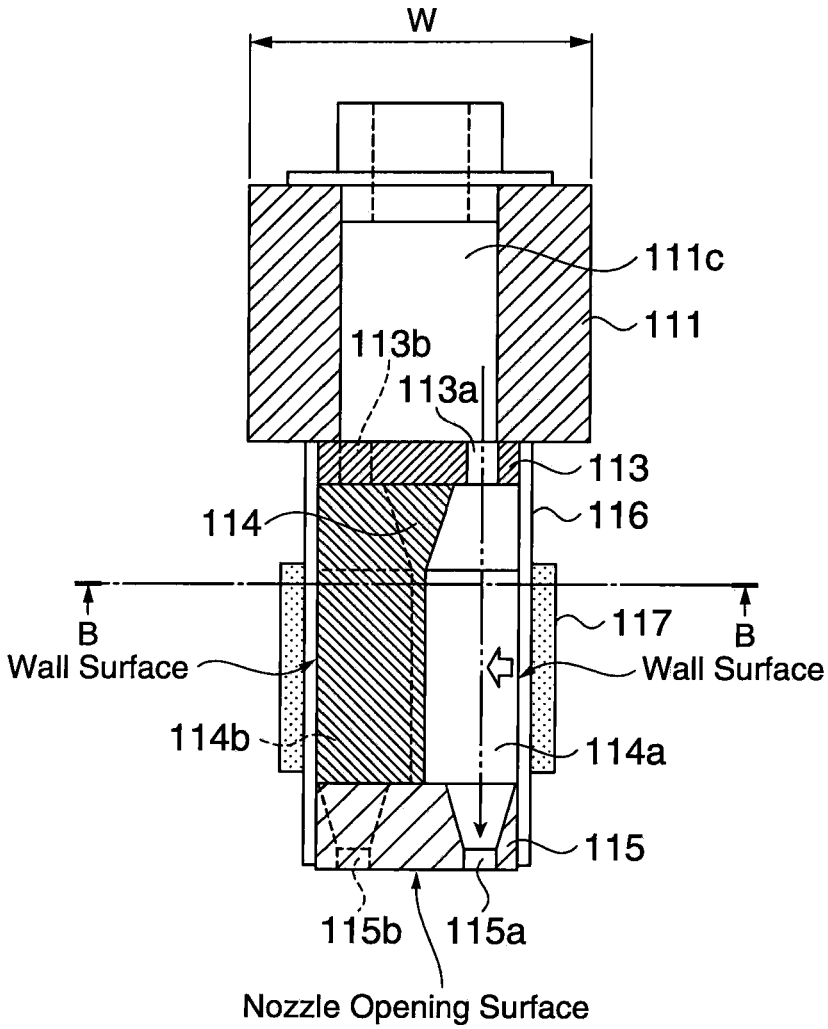
FIG. 3 is a schematic cross-sectional view of a liquid jet head in accordance with an embodiment of the invention.

As shown in FIG. 3, the communication plate 113, the pressure chamber forming member 114 and the nozzle plate 115 laminated and bonded together are laminated in a manner to form wall surfaces that generally orthogonally intersect a surface where the openings of the nozzles 115*a* and 115*b* are formed, in other words, a nozzle opening surface, on the left and right sides at end sections of the nozzle opening surface. It is noted that the wall surfaces to be formed would not necessarily be in a direction orthogonal to the nozzle opening surface. Furthermore, the pressure chambers 114*a* and the pressure chambers 114*b* are formed in the respective wall surfaces of the pressure chamber forming member 114 with their lengthwise direction generally aligned to a vertical direction, such that ink flow paths extend in a direction generally orthogonal to the nozzle opening surface (as indicated by an arrow with two-dot and dash line in the figure). Accordingly, the ink flow paths in the pressure chambers 114*a* and 114*b* are aligned generally in parallel with the wall surfaces. As a result, when the vibration plate 116 is deformed as indicated by a white arrow in the figure by deformation driving of the piezoelectric elements 117, ink in the pressurized chambers 114*a* (114*b*) flows along the ink flow paths, and is ejected through the nozzles 115*a* (115*b*), as described above.

To replenish the pressure chambers 114*a* and 114*b* with ink after ejection, ink is supplied in the pressure chambers 114*a* and 114*b* through the communication holes 113*a* and 113*b* from the reservoir 111*c*. Therefore, in the liquid jet head 110, ink is supplied from a single reservoir 111*c* to all of the formed pressure chambers 114*a* and 114*b* (five each, and ten in total in the present embodiment). It is noted that each of the pressure chambers 114*a* and 114*b* has a tapered section formed near each of the communication holes 113*a* and 113*b* on the ink inlet side for smoothing the ink flow. If the flow of ink is smooth enough, tapered sections may not necessarily be formed.

The communication holes 113*a* and 113*b* are formed in the communication plate 113 by mechanical works such as pressing, drilling and the like, or chemical polishing works such as etching and the like. Also, the nozzles 116*a* and 115*b* are similarly formed in the nozzle plate 115 by mechanical works such as pressing, drilling and the like, or chemical polishing works such as etching and the like.

Figure 4:
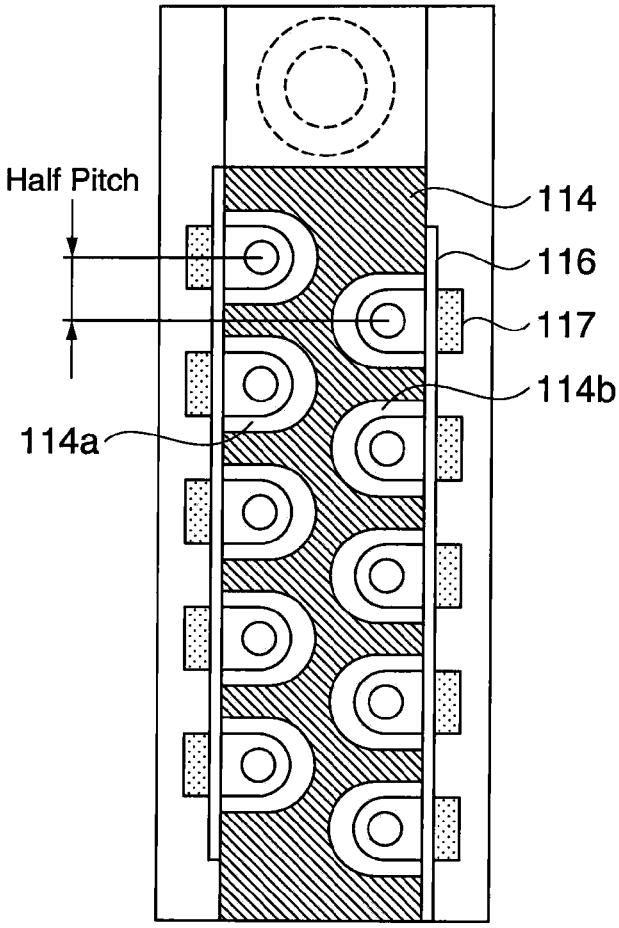
FIG. 4 is a schematic cross-sectional view of the liquid jet head in accordance with the embodiment of the invention.

The pressure chambers 114*a* and 114*b* are composed of concave sections formed in the pair of wall surfaces of a metal plate in a cuboid shape by mechanical cutting work or chemical polishing work. The shape and arrangement of the pressure chambers 114*a* and 114*b* are described with reference to FIG. 4. FIG. 4 is a schematic cross-sectional view taken along a line B-B in FIG. 3.

As shown in FIG. 4, each of the pressure chambers 114*a* and 114*b* formed in the both wall surfaces of the pressure chamber forming member 114 is formed with its cross-sectional shape being a semi-elliptical shape. Furthermore, the pressure chambers 114*a* and the pressure chambers 114*b* are formed shifted from one another by half the pitch thereof, when viewed in a direction perpendicular to the wall surface, in other words, in the main scanning direction. As a result, the distance between the pressure chamber 114*a* and the pressure chamber 114*b* in the main scanning direction can be shortened.

The liquid jet head 110 in accordance with the present embodiment thus structured has two nozzle rows, while its length in the main scanning direction is limited. More specifically, as shown in FIG. 3, the liquid jet head 110 is structured such that ink is supplied from the single reservoir 111*c* to the two nozzle rows formed by the nozzles 116*a* and the nozzles 115*b*, which makes it unnecessary to provide a partition that may be present among multiple reservoirs when ink is supplied from each of the reservoirs to each of the nozzle rows. Therefore, the width dimension W of the supply flow path forming member 111 in the main scanning direction can be sent without any consideration about partitions.

Also, the distance between the pressure chambers 114*a* and the pressure chambers 114*b* in the main scanning direction can be shortened, and synchronized with this state, the distance between the communication holes 113*a* and the communication holes 113*b* in the main scanning direction can also be shortened. As a result, the length of the reservoir 111*c* in the main scanning direction can also be shortened, such that the width dimension W of the supply flow path forming member 111 in the main scanning direction can be made smaller. Of course, the distance between the nozzle row of the nozzles 116*a* and the nozzle row of the nozzles 115*b* in the main scanning direction can also be shortened.

Also, the pressure chambers 114*a* and 114*b* are formed with their lengthwise direction being in a direction orthogonal to the nozzle opening surface, such that ink in the pressure chambers 114*a* and 114*b* can be ejected through the nozzles 116*a* and 115*b*, without having to form the pressure chambers 114*a* and 114*b* in a large area in the main scanning direction. Even when the pressure chambers 114*a* and 114*b* need to be enlarged in size, the pressure chambers 114*a* and 114*b* can be made larger in size by elongating the length of the pressure chamber forming member 114 in the vertical direction, without increasing the thickness thereof in the main scanning direction. Consequently, the gaps between the pressure chambers 114*a* and the pressure chambers 114*b* and the nozzle row of the nozzles 116*a* and the nozzle row of the nozzles 111*b* communicating therewith can be maintained.

By the structure described above, the liquid jet head 110 and the liquid jet heads 120, 130 and 140 are each formed to have a shorter width dimension W in the main scanning direction. As a result, when the liquid jet heads 110-140 are arranged side by side, as shown in FIG. 1, the distance between adjacent ones of the liquid jet heads can be shortened. This is further described with reference to FIG. 5.

Figure 5:
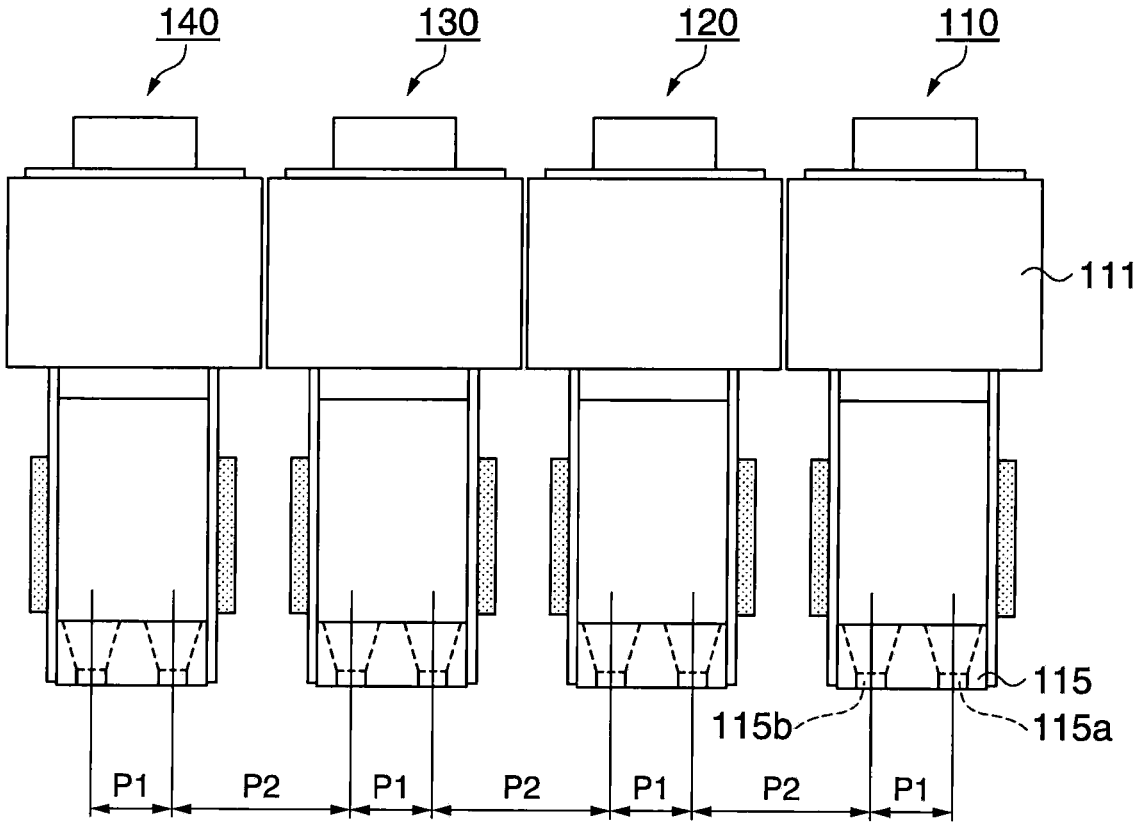
FIG. 5 is a schematic view showing a state in which four liquid jet heads in accordance with an embodiment of the invention are arranged side by side.

FIG. 5 schematically shows the state in which the liquid jet heads 110, 120, 130 and 140 are arranged side by side. As illustrated, in the nozzle plate of each of the liquid jet heads are formed two nozzle rows, i.e., the nozzle row of the nozzles 116*a* and the nozzle row of the nozzles 115*b*, whereby eight nozzle rows in total are formed as the four liquid jet heads 110-140 are arranged side by side. The distance between the nozzle rows formed on each of the liquid jet heads is P1, and the distance between the nozzle rows on adjacent ones of the liquid jet heads is P2. In the case of the structure in which a pressure chamber is disposed in parallel with a nozzle opening surface where nozzles are formed, the distance P2 would become two times or more the length of the pressure chamber, like the structure described in Japanese Laid-open Patent Application JP-A-6-234218. In contrast, according to the present embodiment, the distance P2 does not depend on the length of the pressure chamber, but depends on the width dimension W of the supply flow path forming member 111. Accordingly, because the width dimension W of the supply flow path forming member 111 in the main scanning direction can be shortened, as described above, the distance P2 between the nozzle rows can be made shorter, compared to the structure in conventional art.

As described above, according to the liquid jet head in accordance with the present embodiment, the pressure chambers are formed in the wall surfaces that are formed at end sections of the nozzle opening surface and orthogonal to the nozzle opening surface, and the liquid in the pressure chambers flows in a direction in parallel with the wall surfaces. Accordingly, the lengthwise direction of the pressure chambers can be set along a direction in parallel with the wall surfaces, such that the forming region of the pressure chambers in a direction orthogonal to the direction of the nozzle rows, as viewed toward the nozzle opening surface, can be restrained to a smaller area. As a result, the with dimension of the liquid jet head in the main scanning direction can be reduced, such that, when a liquid jet head with two or more nozzle rows is formed, the gap between adjacent ones of the nozzle rows can be narrowed.

The invention is described above, using one embodiment. However, the invention is not limited to the embodiment, and many changes can be made within the range that does not depart from the subject matter of the invention. Some modified examples are described below.

First Modified Example

In the embodiment described above, the width dimension W of the supply flow path forming member 111 at each of the liquid jet heads 110-140 (see FIG. 3) is described as being greater than the distance between the piezoelectric elements 117 respectively formed on the two wall surfaces. However, the invention is not particularly limited to this structure. When the supply flow path forming members 111 are arranged side by side in contact with one another, problem may arise in that adjacent ones of the piezoelectric elements 117 may interfere with each other and normal pressurizing operations among the liquid jet heads may not be carried out. In order to prevent such a problem from happening, there may be provided a frame having a height greater than the maximum thickness of the pressurizing device, in other words, the maximum displacement position of the piezoelectric element in deforming operation, whereby the distance between adjacent ones of the liquid jet heads is set to a shortest distance at which the pressurizing operation can be normally carried out. Such a modified example is described, using FIG. 6.

Figure 6A:
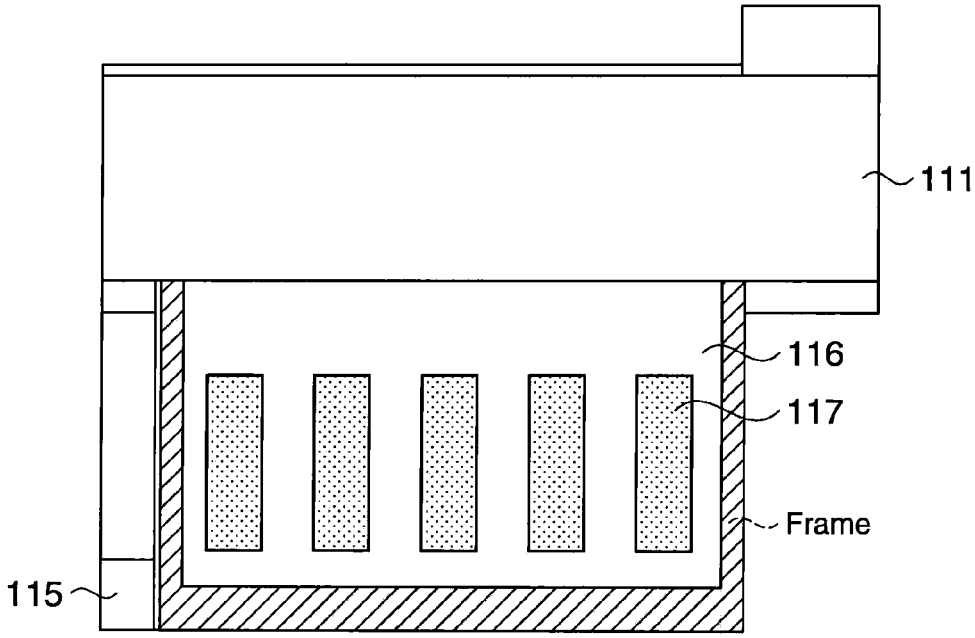
FIG. 6A is a schematic view of the right side surface of the liquid jet head.

FIG. 6A is a schematic view showing the right side face of the liquid jet head 110, which has a "frame" in a channel shape and having a height greater than the maximum displacement height of the piezoelectric element in its deformation operation, bonded and affixed to edge areas of the vibration plate 116, in a range that does not interfere with deformation driving of the piezoelectric elements adhered to the surface of the vibration plate 116. As a result, operation of each of the liquid jet heads is securely maintained, while the gap among the arranged liquid jet heads can be minimized to the extent that the piezoelectric elements would not interfere with one another. The frame is a member that may be composed of metal or ceramic, and another frame is also bonded and affixed to the surface of the vibration plate 116 provided on the right side face of the liquid jet head 110.

Figure 6B:
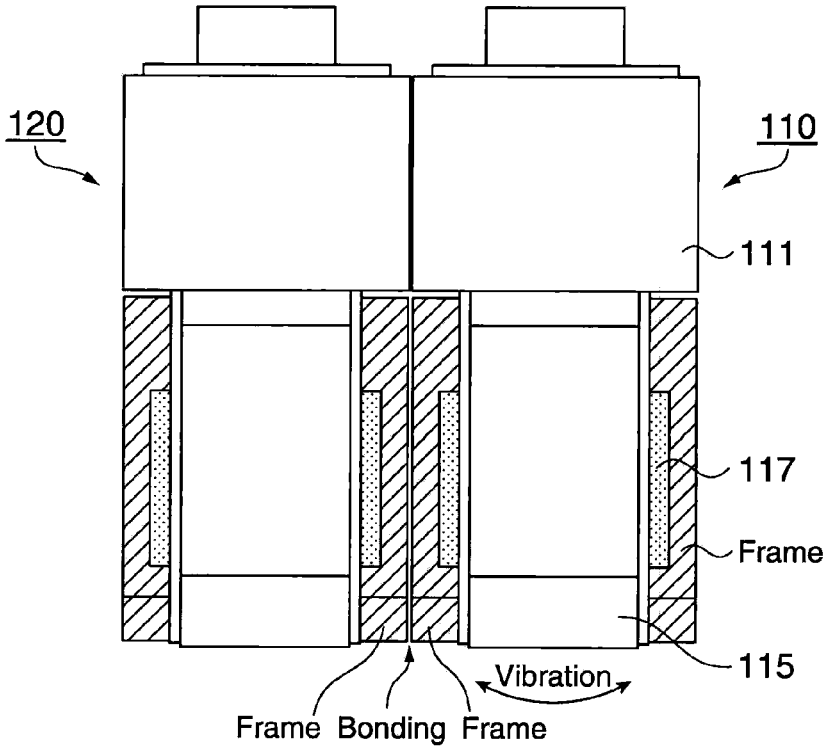
FIG. 6B is a schematic view showing a state in which two liquid jet heads arranged side by side, wherein frames are affixed with adhesive to both side surfaces of each of the liquid jet heads.

FIG. 6B is a schematic view showing an example in which a liquid jet head 110 and a liquid jet head 120, each having frames affixed with adhesive to both side faces thereof, are arranged side by side in an ink jet printer 10. As shown in the figure, the frames affixed with adhesive to the left and right side faces have a specified thickness such that the frames generally mutually abut each other when the liquid jet heads are arranged side by side. Further, the frames are mutually bonded and affixed with adhesive at the abutting portions.

By bonding and affixing the frames to both side faces of each of the liquid jet heads, the distance between adjacent ones of the liquid jet heads, when arranged side by side, can be made to a shortest distance in which pressurizing driving of the piezoelectric elements would not be interfered, and pressurizing operations thereof can be normally carried out.

It is understood from the description above that each of the liquid jet heads 110-140 in accordance with the present embodiment has an elongated shape longer in the vertical direction than in the transverse direction. As a result, when the four liquid jet heads 110-140 are arranged side by side in the liquid jet apparatus, a portion thereof located below the supply flow path forming members 111 has a comb teeth shape, as shown in FIG. 5. For this reason, the nozzle plates 115 located at tips of the comb teeth portion in particular would likely vibrate in the main scanning direction, due to pressurizing operations for ejection of ink, vibrations at the time of movement of the carriage 20 and the like. In contrast, in accordance with the present modified example, the "frames" are provided on the wall surface areas of the liquid jet heads, as shown in FIG. 6A, the rigidity of the liquid jet heads can be increased. Also, when the liquid jet heads are arranged side by side, the comb teeth portions are integrated into one piece through bonding the frames together, such that their rigidity is further increased. As a result, the effect of suppressing vibration of the nozzle plates 115 in the main scanning direction can also be exhibited, as indicated in FIG. 6B.

It is noted that the shape of the frame is not limited to a channel shape. For example, the frame may be in an L-letter shape, or a square shape with frame members on four sides. Alternatively, the frame may be in a linear bar that may be present only at the portion of the nozzle plate. The frame may be in any shape, as long as the shape enhances the rigidity of the liquid jet head and does not influence ink pressurizing operations.

According to the first modified example described above, when liquid jet heads each having two nozzle rows are arranged side by side to form a liquid jet head device having two or more nozzle rows, frames having a height greater than the thickness of the piezoelectric elements that are pressurizing device are provided. As a result, the distance between adjacent ones of the liquid jet heads can be set to a shortest distance in which the pressurizing devices formed at the respective liquid jet heads would not interfere with one another, and therefore the gap between the nozzle rows can also be narrowed. Also, by providing the frames, the rigidity of the liquid jet head device can be increased.

Second Modified Example

In the embodiment described above, the pressure chamber forming member 114 is formed from a single member. However, two members may be bonded together to form a pressure chamber forming member. By so doing, pressure chambers can be formed on one side of the member, and the process of forming pressure chambers can be simplified.

Figure 7:
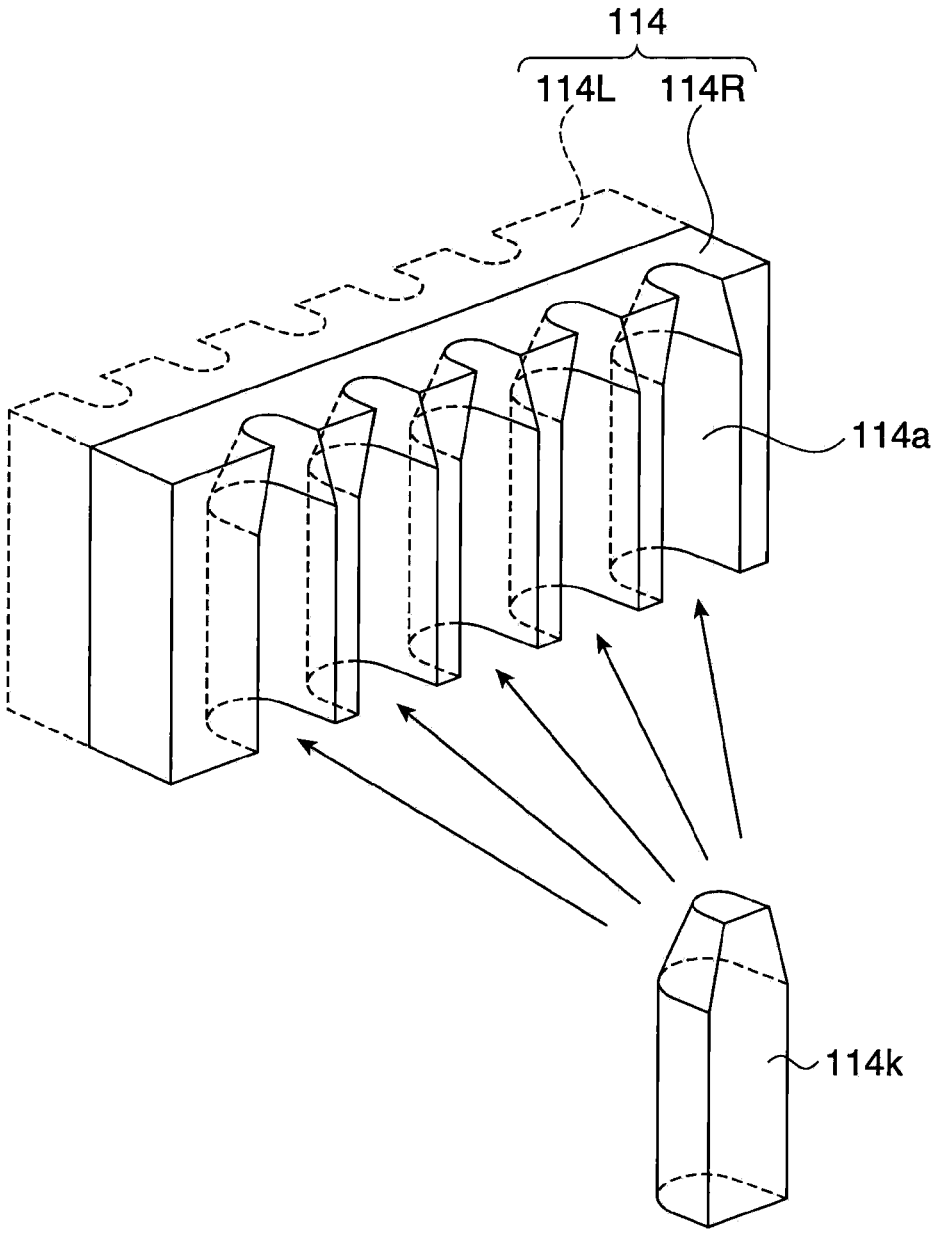
FIG. 7 is a perspective view of a pressure chamber forming member that is formed by bonding two members together.

The second modified example is described, using FIG. 7. FIG. 7 is a perspective view of a pressure chamber forming member 114 which is formed from two members 114R and 114L bonded together. The member 114R has five concave portions as illustrated, which are formed by cutting work or etching work, each functioning as a pressure chamber 114*a*. In accordance with an aspect of the present modified example, the member 114L is exactly the same as the member 114R, and the two members 114L and 114R are bonded together with their concave portions facing outwardly, thereby forming the pressure chamber forming member 114. In this manner, as two of the members are bonded together to form the pressure chamber forming member, formation of the concave portions can be done only in one surface, such that the process for forming the pressure chambers 114*a* and the pressure chambers 114*b* becomes easier.

It is noted that, for forming the concave portions, other methods may be used. For example, a shaped mold 114*k* shown on the lower side of FIG. 7 may be used as an electrode, and a discharge processing may be conducted. Alternatively, although not shown, the shaped mold 114*k* may be used as a core mold, and an electroforming mold having five of the core molds arranged at intervals corresponding to the pitch gaps may be prepared. Then, an electroforming method may be applied thereby electrodepositing metal such as nickel on the mold.

Third Modified Example

In the embodiment described above, the ink flow path downstream of the reservoir is formed from three members of the communication plate 113, the pressure chamber forming member 114 and the nozzle plate 115. However, the ink flow path downstream of the reservoir may be formed from a single member. As a result, the number of parts can be reduced, and therefore the step of bonding the above-described three members can be eliminated. It is noted that, in the present modified example, two members may also be adhered together, like the first modified example. There is of course no problem if they are formed from a single member.

Figure 8:
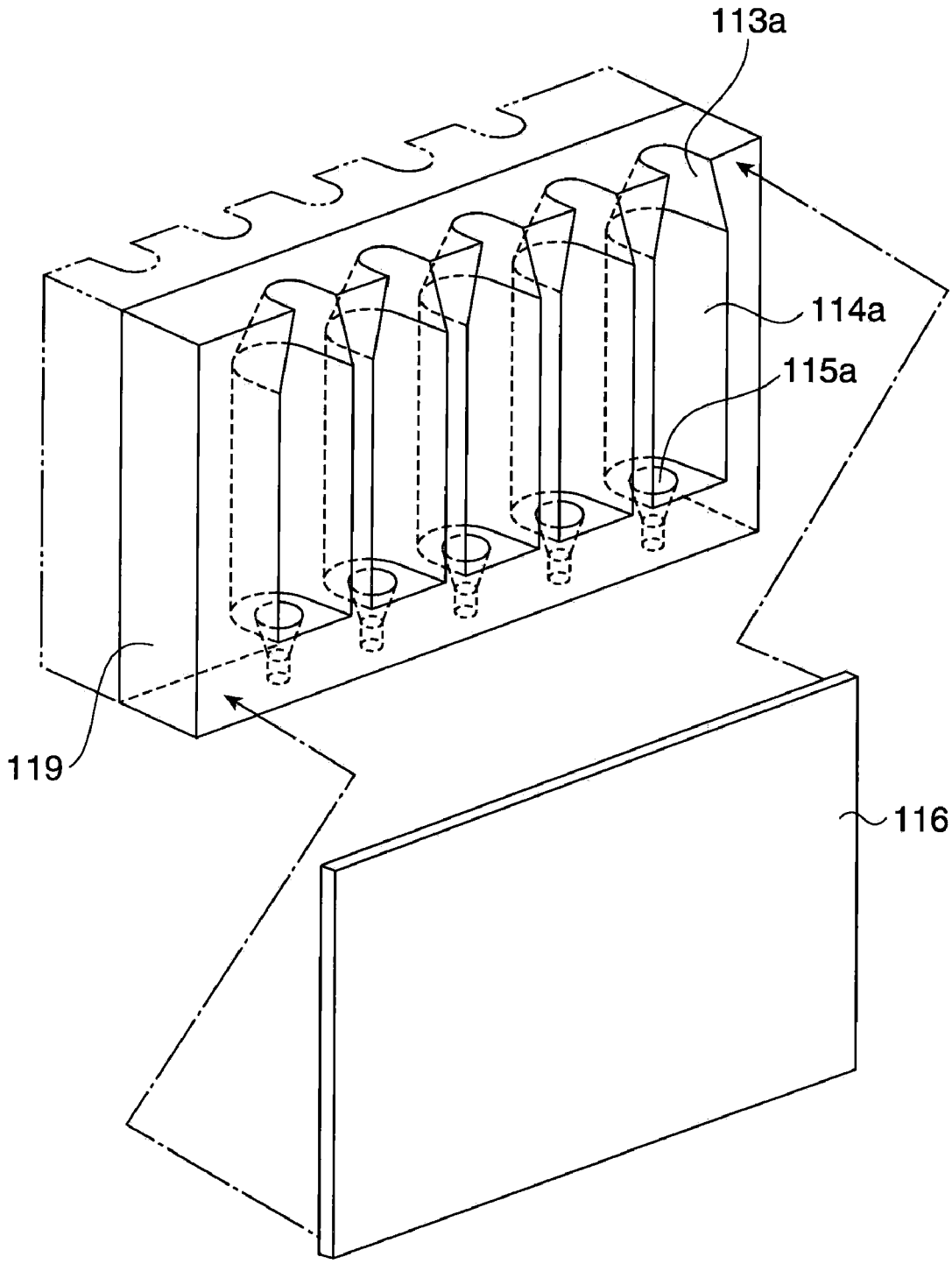
FIG. 8 is a perspective view of an example that has a communication plate and a member including a pressure chamber forming member and a nozzle plate formed in one piece.

The third modified example is described with reference to FIG. 8. FIG. 8 is a perspective view of a member 119, which is an example in which a communication plate 113, a pressure chamber forming member 114 and a nozzle plate 115 are formed in one piece. Five concave sections in total having a configuration as illustrated are formed in the member 119, wherein each of the concave sections functions as a communication hole 113*a*, a pressure chamber 114*a* and a nozzle 116*a*, as shown in the figure. The present modified example is different from the embodiment described above in that the member 119 forms the communication holes 113*a* with a vibration plate 116 affixed thereto.

The concave sections of the present modified example may be formed by electroforming. For example, the formed mold 114*k* shown in the lower side of FIG. 7 may be added with core shaped portions having a portion for the communication hole 113*a* and a portion for the nozzle 115*a*, thereby preparing a formed mold (not shown) as a single core mold. Five of the core molds are arranged at intervals corresponding to the pitch intervals of the five nozzles to prepare an electroforming mold. Then, an electroforming method may be used thereby electrodepositing metal such as nickel on the mold.

Fourth Modified Example

The ink jet printer 10 in accordance with the embodiment described above includes four liquid jet heads arranged side by side, as shown in FIG. 1, which eject YMCK inks, respectively. Accordingly, the gap between adjacent ones of the liquid jet heads 110-140 in the main scanning direction is determined by the width dimension W of the supply flow path forming member 111 (see FIG. 3) in the embodiment described above. In accordance with an aspect of the invention, the supply flow path forming members 111 of the liquid jet heads 110-140 may be integrated by forming them from a single member. As a result, the gap between adjacent ones of the nozzle rows among the liquid jet heads can be narrowed.

Figure 9A:
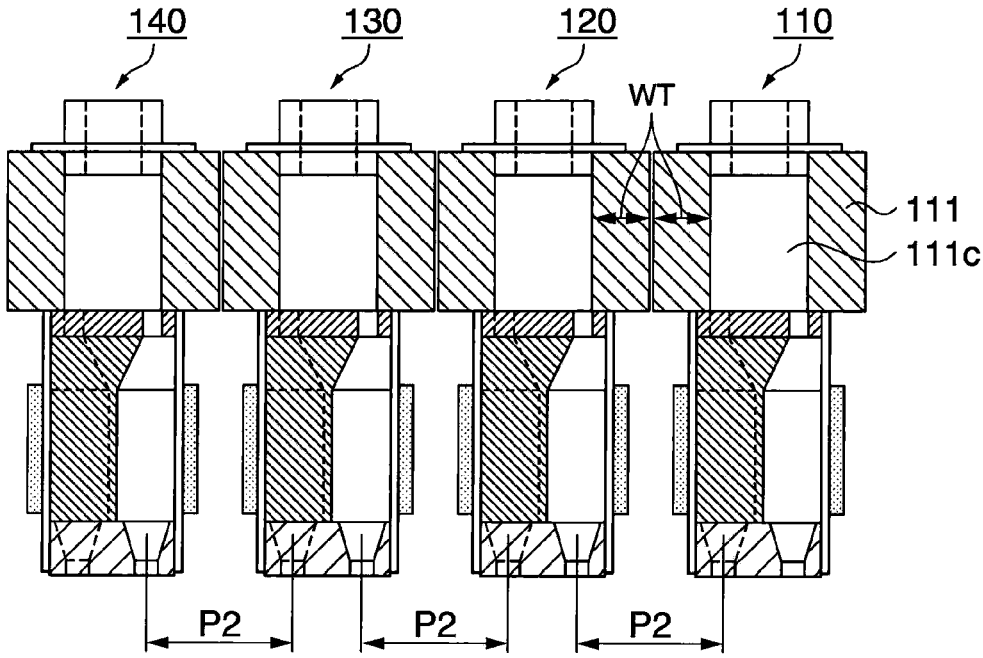
FIG. 9A is a schematic cross-sectional view showing a state in which fourth liquid jet heads are disposed side by side in parallel with the main scanning direction.
Figure 9B:
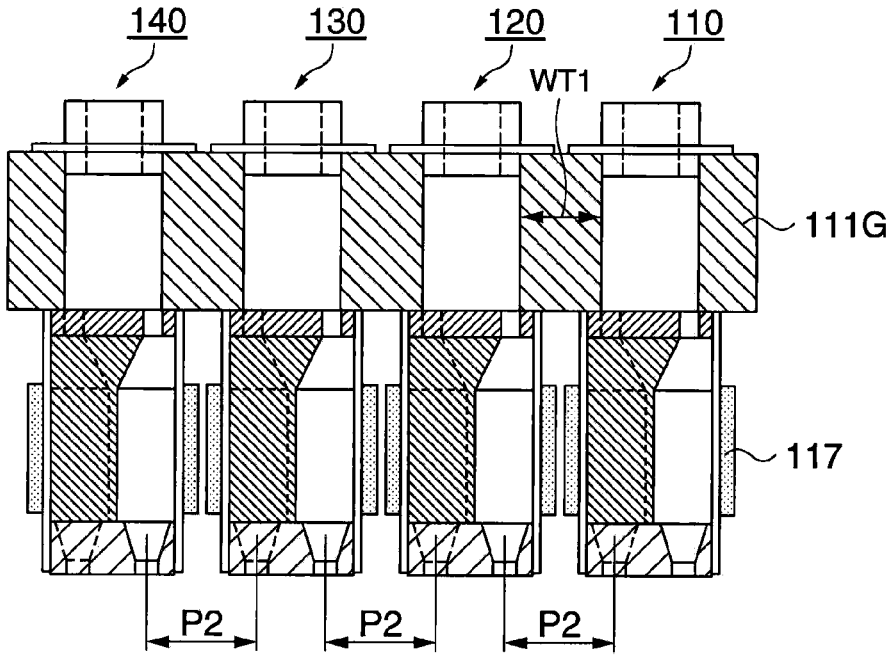
FIG. 9B is a schematic view showing a state of a single member in which supply flow path forming members for four liquid jet heads are formed in one piece.

The fourth modified example is described, using FIGS. 9A and 9B. FIG. 9A is a schematic cross-sectional view showing a state in which four liquid jet heads 110-140 are arranged side by side in the main scanning direction (in the left-to-right direction in the figure), which has the same structure as the one shown in FIG. 5. Accordingly, the distance between the nozzle rows between adjacent ones of the liquid jet heads is P2. The distance P2 is determined by the width dimension W of the supply flow path forming section 111 as described above, more specifically, by the thickness dimension of the partition section in the main scanning direction of the supply flow path forming member 111 which forms the reservoir 111*c*. Therefore, when four liquid jet heads are arranged side by side, the nozzle-to-nozzle distance P2 depends on the distance that is twice the thickness WT of the partition section of each of the supply flow path forming members 111, as shown in the figure.

Therefore, in accordance with the modified example, as shown in FIG. 9B, supply flow path forming members 111 of four liquid jet heads are integrated and formed from a single member 111G. As a result, the thickness of a partition section WT1 between adjacent ones of the reservoirs 111*c* can be made smaller than the aforementioned thickness, 2×WT, and the partition section can be thinned to the extent that the piezoelectric elements 117 do not mutually interfere when driving, such that the nozzle-to-nozzle distance P2 can be further shortened.

Fifth Modified Example

In the embodiment described above, as shown in FIG. 2B and FIG. 3, the pressure chambers 114*a* and 114*b* that are formed in the ink flow paths downstream of the reservoirs 111*c* provided in the liquid jet head are formed respectively in the two wall surfaces that extend generally orthogonal to the nozzle opening surface. Accordingly, the pressure chambers 114*a* and 114*b* that are formed in the respective wall surfaces define flow paths in parallel with the respective wall surfaces, and having their lengthwise direction along a direction generally orthogonal to the nozzle opening surface. Therefore, the dimension of the pressure chambers 114*a* and 114*b* in the lengthwise direction would be restricted by the length of the pressure chamber forming member 114 in the top-to-bottom direction. However, for example, when it becomes necessary to enlarge the pressure chambers 114*a* and 114*b* in size to obtain enough displacement of the vibration plate 116 necessary for ejection of ink, the top-to-bottom dimension of the pressure chamber forming member 114 needs to be made longer, in accordance with the embodiment described above, in order to make the dimension of the pressure chambers 114*a* and 114*b* in the lengthwise direction greater. As a consequence, the comb teeth portion of the liquid jet heads 110-140 becomes longer, which causes a problem in that the vibration amplitude of the nozzle plate 115 would become greater, as described above.

In accordance with the fifth modified example, the pressure chambers 114*a* and 114*b* are formed such that ink flows in a direction in parallel with the respective wall surfaces, and the pressure chambers 114*a* and 114*b* have their lengthwise direction in a direction diagonal to the nozzle opening surface. As a result, the pressure chambers 114*a* and 114*b* can be made larger in size without enlarging their forming region with respect to the main scanning direction, and without extending the top-to-bottom dimension of the pressure chamber forming member 114.

Figure 10:
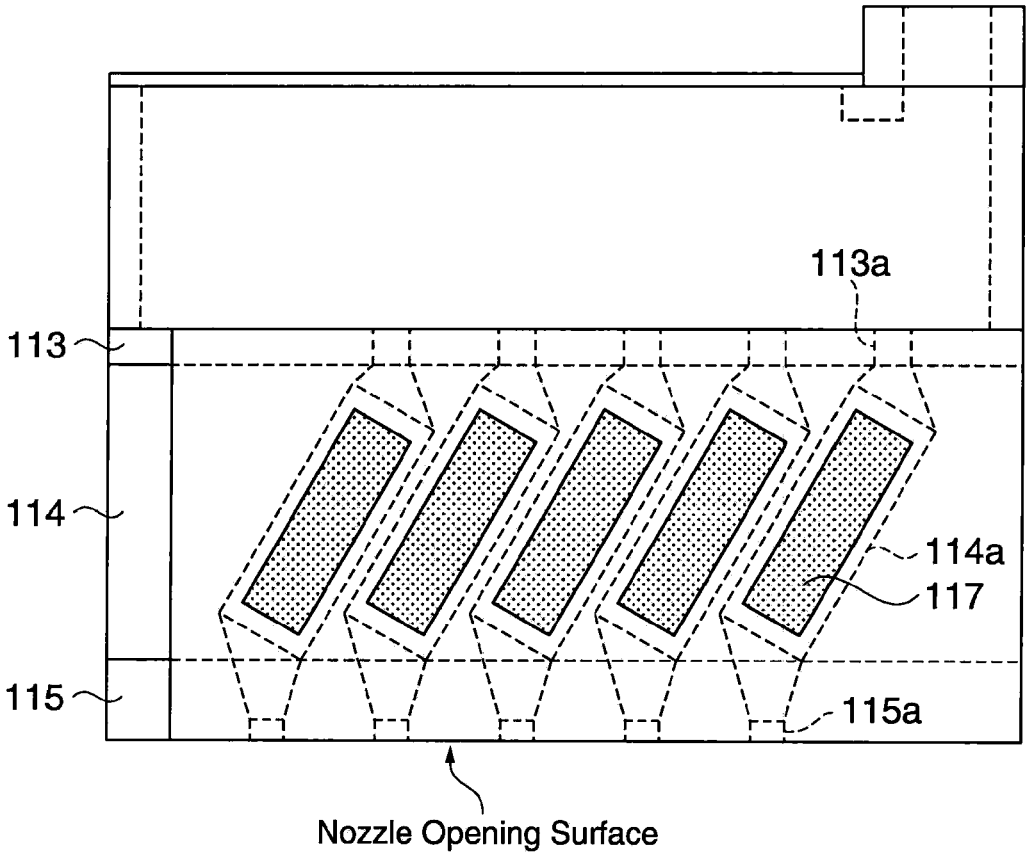
FIG. 10 is a schematic view of a liquid jet head in accordance with a modified example of the embodiment.

The fifth modified example is described with reference to FIG. 10. FIG. 10 shows a state in which the present modified example is applied to the liquid jet head 110 shown in FIG. 2B, as an example. As shown in the figure, the pressure chambers 114*a* have their lengthwise direction formed slanted with respect to the nozzle opening surface. Accordingly, the dimension in the lengthwise direction is obviously greater than the dimension of pressure chambers if they were formed in the vertical direction (see FIG. 2B). In this manner, the pressure chambers 114*a* can be made larger in size without extending the dimension of the pressure chamber forming member 114 in the top-to-bottom direction. It is noted that, as the pressure chambers 114*a* are greater in size, the piezoelectric elements 117 can also be made larger for stably ejecting ink if necessary.

It is noted that, as the pressure chambers 114*a* are diagonally formed, the communication holes 113*a* in the communication plate 113 and the nozzles 116*a* in the nozzle plate 115 are formed at positions according to the forming positions of the pressure chambers 114*a*. Furthermore, although not shown, the pressure chambers 114*b* located at the back side of the figure surface (on the right side surface) are similarly formed with their lengthwise direction being diagonal, and the communication holes 113*b* and the nozzles 115*b* are formed accordingly at their corresponding positions, respectively.

Other Modified Examples

In the embodiment described above, the inlet ports through which ink flows in the liquid jet heads 110-140 are described as being formed in the supply flow path forming member 111 (see, for example, FIG. 2). However, without being limited to the above embodiment, ink inlet ports may be provided in the thin film member 112. More specifically, holes may be formed in the thin film member 112, and ink may be made to flow in through the opened holes. As a result, ink inlet ports 111*a* do not need to be formed in the supply flow path forming member 111, whereby the shape of the supply flow path forming member 111 becomes simpler, and its manufacturing load can be made lighter.

Moreover, in the embodiment described above, the cross-sectional shape of the pressure chamber is described as being in a semi elliptical shape. However, without being limited to the embodiment, the cross-sectional shape may be in a rectangular shape, such as, for example, a quadrangular shape, a trapezoidal shape, and the like. Alternatively, they may be in a triangular shape or a circular shape. The pressure chamber can be in any cross-sectional shape that can be formed by any processing method, such as, mechanical work, chemical polishing work, and the like, and which allows a nozzle to eject ink. It is noted that the pressure chambers to be formed in the two wall surfaces would not necessarily be mutually shifted by half the pitch. In particular, if the thickness of the pressure chamber forming member cannot be reduced even by shifting them by half the pitch in the main scanning direction, the pressure chambers do not have to be mutually shifted by half the pitch. However, in this case, the nozzles may preferably be formed at positions mutually shifted by half the pitch. By this, the deposition pitch of ink droplets can be narrowed as the positions of ejection of ink droplets are made different from one another in the main scanning direction, and thus images can be formed at higher resolutions.

Furthermore, in the embodiment described above, the carriage 20 is described as having fourth liquid jet heads 110-140 mounted thereon. However, the number of liquid jet heads can be increased or reduced, without being limited to the embodiment described above. As described above, when the ink jet printer 10 of the embodiment described above is provided with at least two liquid jet heads, the distance between nozzle rows between adjacent ones of the liquid jet heads can be shortened.

Furthermore, in accordance with the embodiment described above, the ink jet printer is described as of a type in which the carriage having liquid jet heads for ejecting ink mounted thereon is reciprocally moved in the main scanning direction orthogonal to the print paper feed direction. However, the invention is not at all limited to such an embodiment. An apparatus for ejecting ink droplets onto a printing paper by an ink jet printer equipped with a line head having nozzles formed along the entire width of a printing paper may be used as a liquid jet apparatus in accordance with an embodiment of the invention.

Moreover, in accordance with the embodiment described above, the liquid jet apparatus having liquid jet heads mounted thereon is described as being the ink jet printer 10 that ejects ink as liquid. However, the invention is not limited to the embodiment. For example, the invention is also applicable to apparatuses that record images, patterns, characters and the like onto objects by ejecting functional liquid, using a system that is capable of ejecting liquid, such as, for example, a manufacturing apparatus that forms wiring patterns and a manufacturing apparatus that forms color filters by ejecting functional liquid onto a glass substrate, a resin substrate and the like.

Also, in the embodiment described above, as a method for ejecting ink droplets, a system that uses piezoelectric elements 117 is described. However, besides the above-described system, the invention is also applicable to a so-called thermal system that ejects ink droplets by using heating devices.

What is claimed is:

1. A liquid jet head that pressurizes liquid and ejects the liquid through nozzles in a liquid ejecting direction, the liquid jet head comprising:

a nozzle opening surface having first and second nozzle rows each having openings of the nozzles linearly aligned in plurality;

first and second walls that are provided parallel to each other at first and second end sections of the nozzle opening surface, respectively, and that are perpendicular to the nozzle opening surface, and the first and second walls are aligned with the first and second nozzle rows, respectively; and first and second pressure chambers that are in communication with the nozzles of the first and second nozzle rows, respectively, for reserving the liquid to be pressurized, the first pressure chamber is provided next to the first wall, and the second pressure chamber is provided next to the second wall, wherein a lengthwise direction of the first and second pressure chambers is aligned to the liquid electing direction and is perpendicular to the nozzle opening surface, and the liquid pressurized in the first and second pressure chambers flows in the liquid electing direction along the first and second walls, respectively.

2. A liquid jet head according to claim 1, wherein each of the first and second pressure chambers that are provided next to the first and second walls, respectively, is formed in a single member.

3. A liquid jet head according to claim 1, further comprising:

a supply flow path that is in communication with all of the first and second pressure chambers formed along the first and second nozzle rows and that supplies the liquid to the first and second pressure chambers, wherein the supply flow path is provided opposite to the nozzle opening surface through the first and second pressure chambers.

4. A liquid jet head according to claim 1, wherein all of the first and second pressure chambers formed along the first and second nozzle rows, respectively, have an identical configuration, wherein the first and second pressure chambers are formed mutually shifted as viewed in a direction perpendicular to the first and second walls.

5. A liquid jet head according to claim 1, further comprising:

a pressurizing device is provided on a surface of the first and second walls in a position corresponding to each of the first and second pressure chambers for pressurizing liquid in the first and second pressure chambers; and a frame having a thickness at least greater than a maximum thickness of the pressurizing device is provided at least in the vicinity of the first and second end sections of the nozzle opening surface, and the frame is provided at out of an area where the pressurizing device interferes with the frame.

6. A liquid jet apparatus comprising at least two liquid jet heads recited in claim 1.

* * * * *